US005887578A

United States Patent [19]

Backeris et al.

[11] Patent Number: 5,887,578

[45] Date of Patent: Mar. 30, 1999

[54] BALL PROJECTING ATTACHMENT FOR VARIOUS AIR BLOWERS

[76] Inventors: Dean A. Backeris, 3035 Haberlein Rd., Gibsonia, Pa. 15044; James P. Kappernaros, 1205 Powers Run Rd.; Frank J. Costa, 100 Foxtop Rd., both of Pittsburgh, Pa. 15238

[21] Appl. No.: 920,180

[22] Filed: Aug. 25, 1997

[51] Int. Cl.[6] ..... F41B 15/00

[52] U.S. Cl. ..... 124/49; 124/50; 124/53; 124/56; 124/72; 42/55; 273/317.7

[58] Field of Search ..... 124/56, 72, 45, 124/48, 49, 50, 51.1, 52, 53; 42/54, 55; 273/317.4, 317.7

[56] References Cited

U.S. PATENT DOCUMENTS

| | | | |
|---|---|---|---|
| 3,855,988 | 12/1974 | Sweeton | 124/56 |
| 3,905,349 | 9/1975 | Nielsen et al. | 124/56 |
| 4,021,037 | 5/1977 | Torbet | 273/30 |
| 4,273,095 | 6/1981 | Speer | 124/56 |
| 5,133,330 | 7/1992 | Sharp | 124/56 |
| 5,251,906 | 10/1993 | Heller et al. | 273/397 |
| 5,257,615 | 11/1993 | Jones | 124/56 |
| 5,496,025 | 3/1996 | Phillips et al. | 273/26 |
| 5,507,271 | 4/1996 | Actor | 124/56 |

*Primary Examiner*—J. Woodrow Eldred

[57] ABSTRACT

An improved ball projecting apparatus for balls of various sizes, weights, materials and shapes, which utilizes air pressure supplied by a separate and independent source of flowing air, such as a leaf blower, to project balls. More specifically, it comprises of a barrel (10) of tubular form defining a linear air discharge axis. The barrel is attached on one end to the source of flowing air (11). A barrel hole (12) is formed in the barrel wall. Attached to the barrel is a tumbler casing (14). The casing has a hollow tubular formation. It has an entry hole (16) and a feed hole (19) formed on its wall directly opposite each other. The tumbler casing is attached and sealed at its feed hole to the barrel hole creating a path or feed port through the casing and into the barrel. Inside the casing is a tumbler (20) being of hollow tubular shell formation which is solid on all walls and ends except for a tumbler hole (22) formed on its wall, exposing the tumbler chamber into which a ball is deposited. This tumbler is capable of being revolved within the casing. The tumbler has a driveshaft (23) attached which is turned by an electric motor (24). A collar (21) surrounds the entry hole and holds a ball in place above the hole. A ball is placed above the entry hole within the collar. As the tumbler revolves within the casing the tumbler hole aligns itself alternately with the entry hole and the feed hole of the tumbler casing. The ball drops into the tumbler when the tumbler hole and the entry hole are aligned. The tumbler continues its revolution. The ball is loaded into the barrel when the tumbler hole and the feed hole are aligned. The tumbler and tumbler casing continuously maintain an obstacle to air loss through the barrel hole, reducing air pressure release from the air source through the barrel hole and permitting a ball to be loaded from atmospheric pressure. When the ball drops into the barrel it is propelled out the open end of the barrel by the source of flowing air.

3 Claims, 3 Drawing Sheets

BALL PROJECTING ATTACHMENT FOR VARIOUS AIR BLOWERS

BACKGROUND

1. Field of Invention

This patent relates to a previously filed Disclosure Document filed with the United States Patent and Trademark Office in Disclosure Document Number 418,953 on May 9, 1997. Specifically, this invention relates to ball pitching or serving apparatuses, to an improved method for loading objects such as balls of various sizes, weights, and materials, which are exposed to atmospheric pressure, through a hole in the wall of a tube or barrel which is attached on one end to a source of flowing air, while continuing to obstruct the release or loss of air from the source through the hole in the wall of the tube or barrel as the object is loaded.

2. Discussion of Prior Art

Prior art which utilizes a source of flowing air to propel balls or other objects has attempted to overcome the release of flowing air from the source by various methods. These methods are embodied in the following inventions:

i) The Induced Air Device For Discharging Spherical Members, in U.S. Pat. No. 3,905,349 by Nielsen does not overcome the loss of air from its source of flowing air through the hole at which the ball is loaded into the device. Nielsen utilizes a trap door which opens and closes as vacuum pressure and backpressure created by the source of flowing as the ball enters the barrel is utilized to alternately open and close the back door. As the trap door closes air escapes through the opening until the door seals the opening.

ii) The Air-Actuated Ball-Throwing Device and Method Therefor, in U.S. Pat. No. 5,507,271, by Actor, the problem of air loss through the hole in the barrel is only partially overcome as the ball is loaded into the barrel. Actor has created vacuum pressure around the hole by placing a tab on the inside wall of the barrel which diverts the flowing air away from the hole and permits a ball to drop through a tube surrounding the hole creating a point of entry perpendicular to the linear air discharge axis. When the ball is loaded into the barrel the air which the ball obstructs is then forced out the hole in the wall of the barrel, and air pressure to propel the ball is diminished. Actor uses a lid or cover over the supply of balls which seals the container of balls from atmospheric pressure, thereby preventing the escape of air through the hole in the barrel.

iii) The Ball Throwing Machine in U.S. Pat. No. 3,855,988 by Sweeton again uses a trap door which he labels a vane and horizontal pivot is positioned under the ball feed port such that when the vane is in the horizontal position air is prevented from escaping through the port. The vane creates a valve which opens as the weight of the ball in the port presses against it, and closes after the ball enters the air flow and creates backpressure within the device, thereby moving the vane and sealing the valve. Air pressure or flow escapes out the port as the vane closes and seals the valve.

iv) The Relief Pitcher in U.S. Pat. No. 5,133,330 by Sharp utilizes holes in the wall of the tube surrounding its feed port as the release point for the backpressure created by the device at its feed port as the ball is loaded into the barrel. Sharp also utilizes a lower tapered orifice at the barrel's connection point to the source of flowing air in order to create suction pressure at the feed port which is positioned at the suction pressure. With Sharp, air pressure is lost through the feed port as the ball enters the barrel.

v) The Baseball, Softball, and Tennis Training Device in U.S. Pat. No. 5,257,615 by Jones is a device which permits air loss through its feed port as the ball is loaded, the feed port is then sealed over the ball, preventing air loss through the port. The ball then drops into the barrel and is propelled by the force from the source of flowing air. In Jones, and automatic ball feeder from a hopper containing a supply of balls attached over the feed port, must be covered at the top of the hopper, thereby preventing air loss and permitting balls to be loaded sequentially without loss of air through the feed port.

(vi) The Apparatus for dispensing powdered and granulated materials by Dvorak et al, in U.S. Pat. No. 5,779,161 utilizes air inlet and outlet tubes from a container which is attached to a leaf blower to dispense powder or granular material. It does not have a rotating loading mechanism but uses air force from the blower to draw powder from the container through the tubes. The supply of power is not exposed to atmospheric pressure.

(vii) The Pesticide Duster Attachment for Portable Blower by Ussery, in U.S. Pat. No. 5,392,996 also does not have the supply of powder or dust exposed to atmospheric pressure.

(viii) The Garden Powder Duster by Sansalone, in U.S. Pat. No. 5,226,567 has a dusting agent container attached to the tube on the air blower. This container is not exposed to atmospheric pressure.

(ix) The Fertilizer Spreader of Mattson, in U.S. Pat. No. 4,387,852, does not have a supply of fertilizer which is exposed to atmospheric pressure.

(x) The Pesticide Duster by Mesic, in U.S. Pat. No. 4,256,241 does not have a supply of pesticide which is exposed to atmospheric pressure.

Objects and Advantages.

Accordingly, several objects and advantages of the invention are to provide a means for loading balls of various sizes, weights, shapes, and materials, through a hole or feed port in wall of a barrel which is attached to a source of flowing air on one end, without release of air through the feed port, such that a ball which is exposed to atmospheric pressure can be loaded through the port without the loss of air from the source of flowing air through the port. This invention has various embodiments, all of which utilize this method of loading. Each embodiment is simple and can be built or molded of inexpensive hard and lightweight materials such as plastic, metal, steel, resin, or vinyl. It can be assembled quickly, simply and easily by the user. When operational the unit can project balls, from a replenishable supply of balls at atmospheric pressure, in a range of 10 to 85 miles per hour at various targets at various time intervals.

The only disadvantage of the invention is the noise level which is mitigated by the fact that its user will be 40 or more feet away from the invention as it is operated. The inventors are currently developing a means to muffle or reduce the sound level of an air blower.

DRAWING FIGURES

Figure 1:
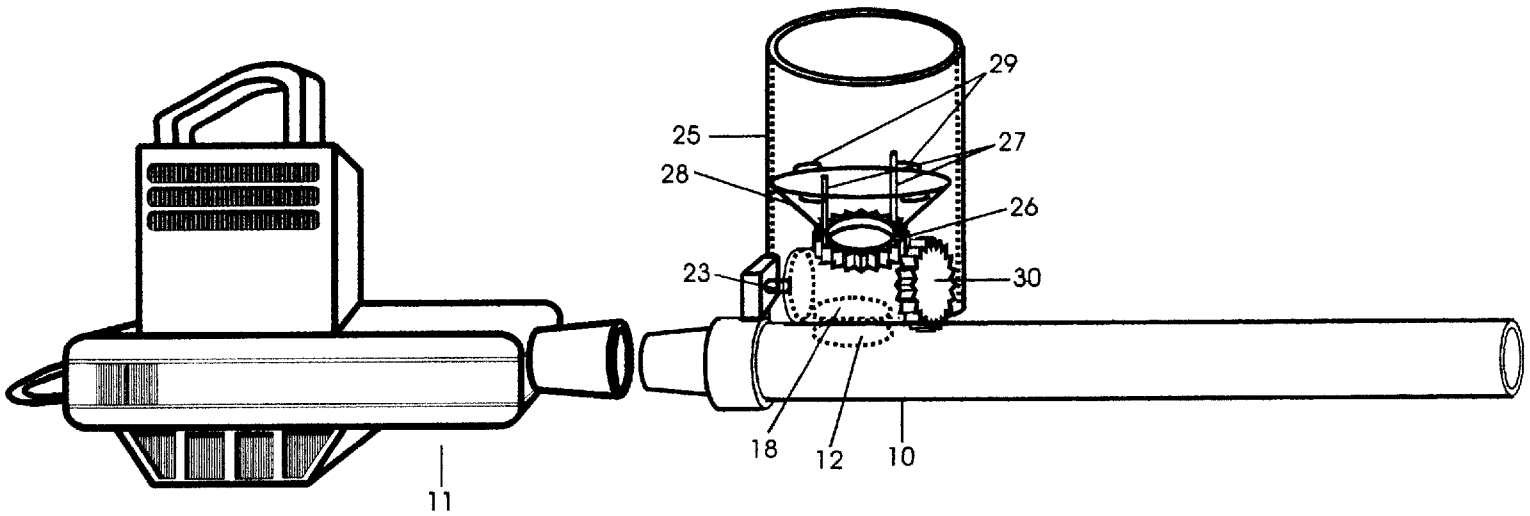
FIG. 1 shows a view of the main portion of the invention with the optional hopper.

| Reference Numerals in drawings | |
|---|---|
| 10 | barrel |
| 11 | air source |
| 12 | barrel hole |
| 14 | tumbler casing |
| 16 | entry hole |
| 18 | feed hole |
| 20 | tumbler |
| 21 | collar |
| 22 | tumbler hole |
| 23 | drive shaft |
| 24 | tumbler chamber |
| 25 | hopper |
| 26 | turnstile ring |
| 27 | posts |
| 28 | funnel |
| 30 | gear |

SUMMARY

In accordance with the present invention a ball projector has a hollow tube or barrel attached on one end to a separate and independent air blower, and is open on the other end, creating a linear air discharge axis. The barrel has a barrel hole on its wall which creates an entry point into the barrel. Attached to the barrel is a tumbler casing comprising of a hollow round shell formation which has a feed hole on one side if its wall which is aligned with and attaches to the barrel at the barrel hole creating a feed port. The casing also has an entry hole on its wall opposite side the feed hole which creates a path through the casing to the feed port. Inside the casing is a solid tumbler which blocks the path through the casing, but which can be moved within the casing. Within the tumbler is a plurality of holes leading to a plurality of separate and distinct chambers. The tumbler and each of its chambers are formed and positioned in such manner that no matter what position the tumbler occupies within the casing, the holes on opposite sides of the casing are sealed from any passage of air between them and air is continuously obstructed from loss or escape out the barrel hole. The tumbler is revolved within the casing by hand or other means such that the chamber is aligned alternately with the entry hole and the feed hole of the casing and vice versa. During this revolution of the tumbler the tumbler prevents air from escaping through the feed port. A ball is positioned at the entry port and the tumbler is revolved. When the chamber is aligned with the entry port the ball drops into the chamber. The tumbler is then revolved to the point at which the chamber is in alignment with the feed port. Air loss through the feed port hole is continuously obstructed by the tumbler. When a ball is in a chamber and the chamber and feed port are aligned, the ball drops into the source of flowing air and is propelled by the force of the flowing air.

In construing the following description of the preferred embodiments of this invention, it should be noted that the word "ball" is utilized as a preferred example of, and as a simple symbol for, any article capable of being projected from a barrel. It is quite clear that the outer circumference of the projectile, and the inter cross-sectional shape of the barrel should be symmetrical. Preferably, of course, the barrel has a circular interior cross-section and the projectile has a circular exterior circumference. Even more preferably, and most commonly, the projectile will be a substantially spherical ball, such as a tennis ball.

DESCRIPTION

Figure 2:
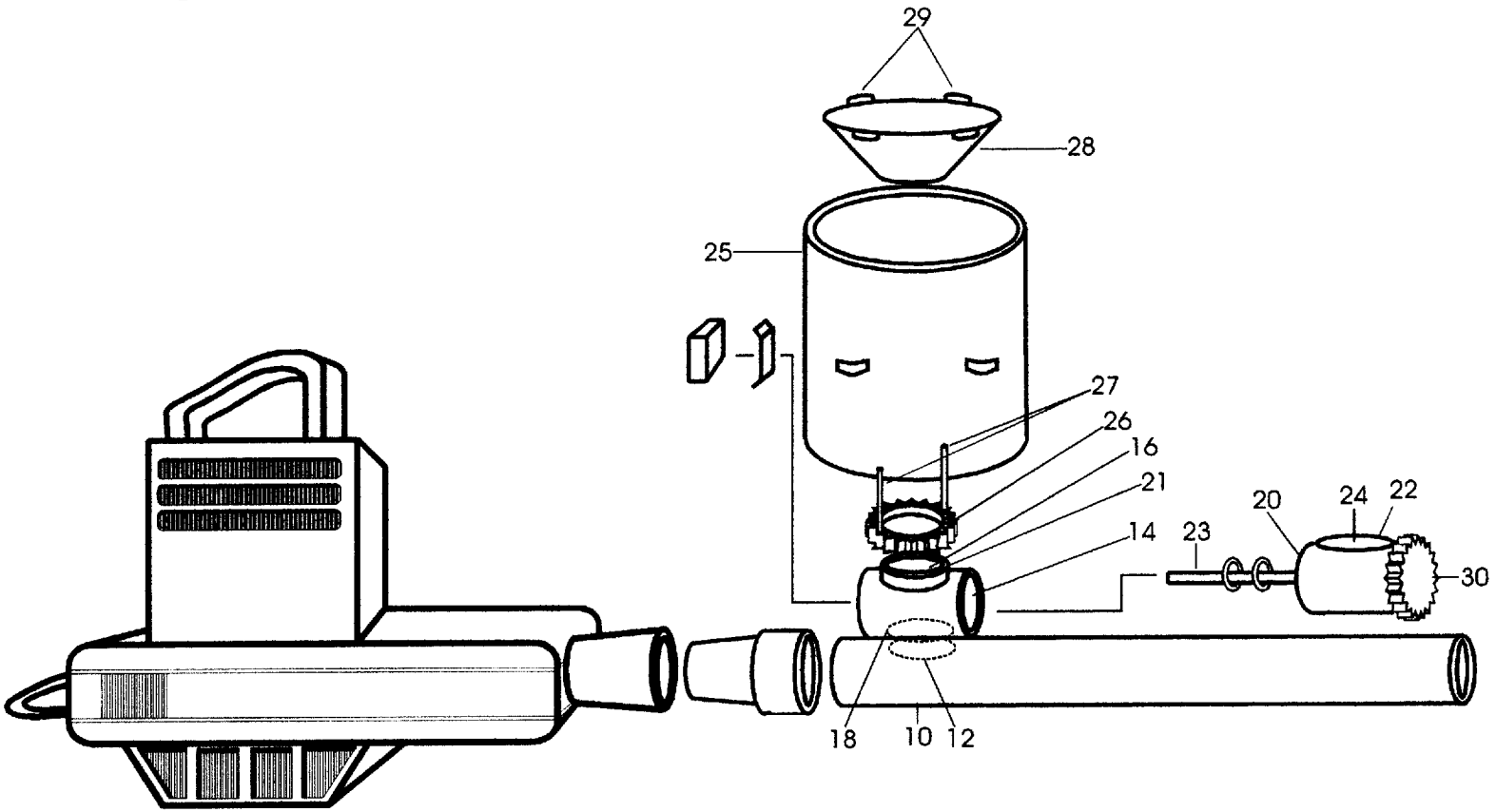
FIG. 2 shows an exploded view of the component parts of the invention.
Figure 3:
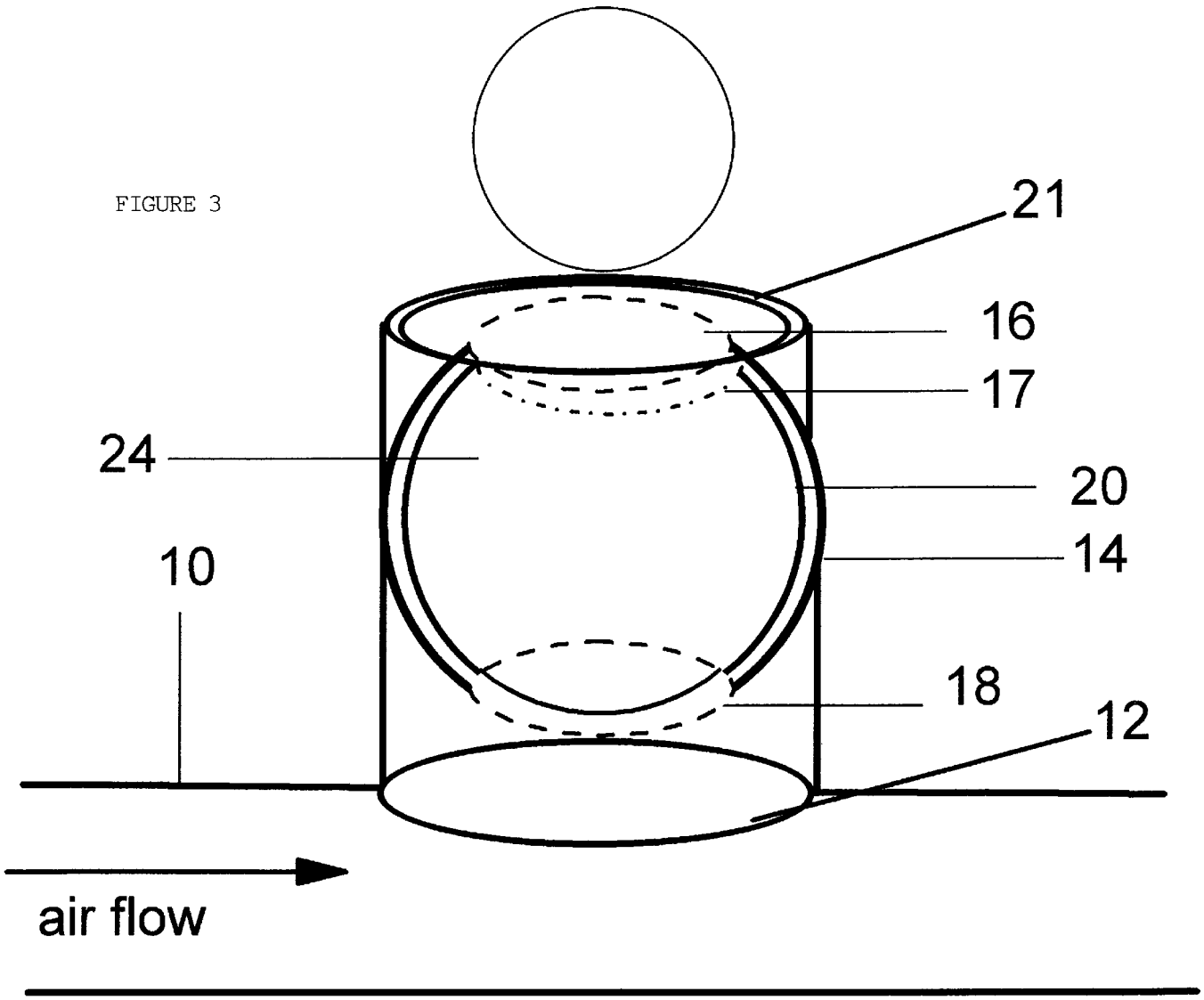
FIG. 3 shows a cross-sectional view of the tumbler and casing.

The typical embodiments of the projection device of the present invention is illustrated in FIGS. 1 through 3.

FIG. 1 shows the assembled view of the preferred embodiment of the invention with optional hopper attached. FIG. 2 shows exploded view of the preferred embodiment of the invention. FIG. 3 shows a cross-sectional view of the tumbler.

The projection device depicted in the figures consists of a tube or barrel 10 which is attached to a source of flowing air 11 on one end and is open on the other end, creating a linear air discharge axis. The barrel has a barrel hole 12 on its wall creating a point of entry into the flowing air. The tumbler casing 14 is a hollow tubular shell solid on its walls except for an entry hole 16 on its wall on one side and a feed hole 18 on the wall opposite the entry hole. The tumbler casing is attached to and sealed at the feed hole to the barrel at the barrel hole, forming a path or feed port through the casing into the barrel. The entry hole has a collar 21 surrounding it. Inside the tumbler casing is a tumbler 20 which occupies the interior of the casing. The tumbler consists of a hollow shell formation with solid walls except for the chamber hole 22 on the tumbler's wall which leads to the tumbler chamber 24. The tumbler and its chamber is formed in such a manner that the tumbler can be revolved to alternate the alignment of the chamber hole with the entry hole and the feed hole and vice versa while continuously obstructing air from escape or loss out the feed port. The tumbler has an drive shaft 22 which when turned by hand or other means causes the tumbler to revolve. As the tumbler revolves, the chamber aligns itself alternately with the entry hole and the feed hole. This alternating alignment causes a ball or other object which is placed at the entry hole to drop into the tumbler hole when the tumbler hole is aligned with the entry hole, and into the barrel when the tumbler hole and the feed hole is subsequently aligned. As the tumbler revolves, enough air is prevented from escaping through the barrel hole so that a ball may be loaded into the barrel to be projected by the power of the flowing air out the open end of the barrel.

An optional attachment for the ball projector is a hopper 25 which provides a supply of balls. The hopper is sufficiently large to hold a supply of more than 100 balls. The collar has a turnstile ring 26 with a gearlike undersurface which fits precisely around the collar. The turnstile ring has two vertical posts 27 formed on its surface directly opposite each other. The posts are approximately the height of the balls.

Above the turnstile ring is a funnel 28. The funnel has sufficient slope to guide the balls toward the toward the entry hole. The funnel tabs snap into the hopper, holding both the funnel and the turnstile ring in place.

One end of the tumbler is has a gear 30 along its circumference which extends slightly above the collar and contacts the undersurface of the turnstile. The turnstile ring rotates as the tumbler revolves its exposed end rides against the rings undersurface. The posts strike balls within the hopper as the turnstile rotates. The posts mix and separate the balls permitting one ball at a time to be positioned at the entry hole. This prevents a jamming of the balls over the entry hole as each ball is dropped into the tumbler. The balls drop individually into the tumbler chamber when the tumbler hole and drop hole are aligned during each revolution of the tumbler.

Conclusion, ramifications, and scope of Invention

Thus the reader will see that the ball projector of the invention has many advantages. It provides an effective, easily powered and used, lightweight, simple, inexpensive, durable, highly reliable and widely available device. It has variable performance and a multiple of applications or uses to persons of all ages. Its method of loading a ball into the barrel overcomes in a simple manner the problem posed to prior art. It does not require any of the features which prior art uses to deal with air loss through the entry point into the barrel. With a motor attached to the loading mechanism, a ball or series of balls are loaded, without an operator, from a supply of balls at atmospheric pressure, directly into the barrel without loss of air at the balls point of entry. This feature permits wider applications for use as a batting, pitching, fielding, or tennis training device. It permits full use of the blower's air power, rapid firing of balls in sequence, and has the ability to place returned balls directly into the device for immediate reuse. It accomplishes these objectives without the need for an operator or second person.

What is claimed is:

1. A projection device for various projectiles comprising of:

(a) a hollow tube which connects on one end to a separate and independent source of air pressure and is open on the other end forming a linear air discharge axis;

(b) a barrel hole on the wall of the barrel creating an entry point into the barrel;

(c) a loading means to load projectiles from atmospheric pressure through said barrel hole while continuously obstructing the flow of air from the source of flowing air out said barrel hole.

2. The projection device of claim 1 wherein said loading means comprises of a tumbler casing having a hollow cylindrical shell formation and having an entry hole and a feed hole directly opposite each other along the wall of said tumbler casing; said tumbler casing being attached at its feed hole directly to the barrel hole, and forms a feed port into said air discharge axis through the casing and said feed hole; said tumbler casing having contained within a tumbler having a hollow cylindrical shape with solid walls and ends except for a tumbler hole on its wall leading to a chamber within said tumbler; said tumbler being inserted into said tumbler casing such that it creates a continuous obstacle to the loss of air flow through said feed port.

3. The tumbler of claim 2 having a drive shaft attached to said tumbler which is attached to an electric motor.

* * * * *